United States Patent [19]

Gratzmuller

[11] 4,009,358

[45] Feb. 22, 1976

[54] ELECTRIC CIRCUIT-BREAKER FOR ALTERNATING CURRENTS

[76] Inventor: Jean Louis Gratzmuller, 66 Boulevard Maurice Barres, Neuilly sur Seine, France, 92200

[22] Filed: May 21, 1975

[21] Appl. No.: 579,593

[30] Foreign Application Priority Data

May 22, 1974 France ..... 74.17800

[52] U.S. Cl. ..... 200/150 B

[51] Int. Cl.[2] ..... H01H 33/68

[58] Field of Search ..... 200/150 B, 150 R

[56] References Cited

UNITED STATES PATENTS

| | | | |
|---|---|---|---|
| 3,002,073 | 9/1961 | Cobine | 200/150 B |
| 3,842,227 | 10/1974 | Gratzmuller | 200/150 R |

*Primary Examiner*—Robert S. Macon
*Attorney, Agent, or Firm*—Holman & Stern

[57] ABSTRACT

A current-interrupting chamber containing stationary and moving contacts is filled with a dielectric consisting of $SF_6$ gas maintained in the liquefied state under a pressure of considerably higher value than the critical pressure. An arc-quenching cylinder placed within the chamber in communication therewith contains a piston which is actuated conjointly with the moving contact so as to discharge a jet of liquid dielectric which is directed between the contacts in the radial centripetal direction and extinguishes the arc formed when the contacts are separated.

15 Claims, 9 Drawing Figures

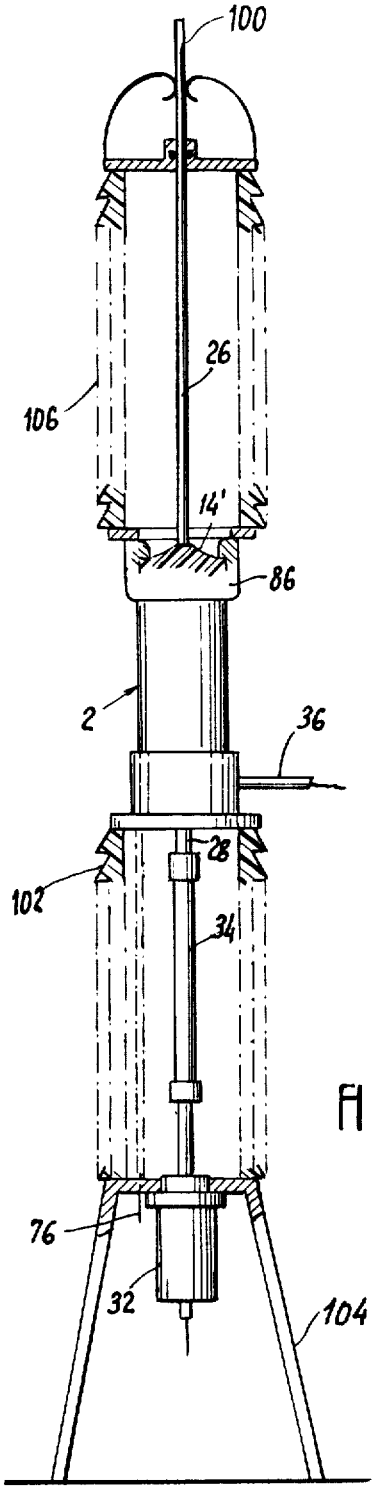
FIG 5
FIG 6
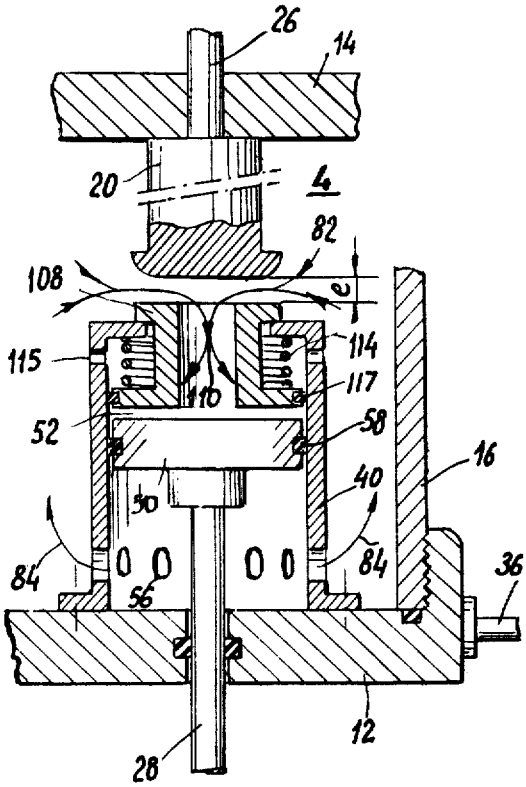

ELECTRIC CIRCUIT-BREAKER FOR ALTERNATING CURRENTS

This invention relates to electric circuit-breakers in which the interrupting chamber containing the contacts for opening or closing the circuit-breaker is filled with a dielectric fluid consisting of a liquefiable dielectric gas which is continuously maintained in the liquid state under a suitable and substantially constant pressure.

The dielectric fluid which is employed in particular in these circuit-breakers is sulphur hexafluoride ($SF_6$) in the liquefied state.

Circuit-breakers of this type have been described especially in French Pat. Nos. 1,430,333 (filed on Jan. 21, 1965), 1,537,673 (filed on Apr. 15, 1966) and 7,135,197 (filed on Sept. 30, 1971) in the name of the same inventor.

The invention is more especially directed to circuit-breakers of this type in which an improved blowout system is provided for extinguishing the arc formed between the contacts at the moment of opening of the circuit-breaker.

In some of the patents cited above, it had already been proposed to equip the circuit-breaker with a blowout or arc-quenching system. In particular, in the third patent aforementioned, quenching was carried out by means of a stream of liquid dielectric which was circulated radially between the contacts in the centripetal direction, said stream being then sucked into an axial duct formed in one of the contacts. The liquid dielectric employed for quenching the arc was withdrawn from the dielectric contained in the interrupting chamber and the intense circulation of the quenching dielectric was produced by displacement of the moving contact during the opening operation of the circuit-breaker. In other words, quenching of the arc stopped as soon as the contacts had reached the spacing corresponding to the open position of the circuit-breaker.

The operation of circuit-breakers of this type proves satisfactory for many applications in which the current has to be interrupted in a very short time. In fact, when making use of the liquefied dielectric $SF_6$, the spacing between the contacts in the open position can be of very small value, for example approximately 10 mm in the case of a voltage of 200 k/volts. This permits a transition from the closed position to the open position of the contacts in a time interval of the order of 1 to 3 milliseconds (ms). By reason of the fact that the quenching time was limited to the contact-opening time in the arc-quenching systems described in the patents cited earlier, this quenching time was therefore also very short. But this does not give rise to any disadvantage in some applications, for example in the case of high-power direct currents which can thus be interrupted by ultra-fast circuit breakers.

In the case of interruption of alternating currents at industrial frequency, at high voltage and high intensity, it is also essential to ensure that the contacts can be moved to the separated position within a very short period of time, but the arc can be extinguished only at the following zerocrossing, that is, after a maximum time-lag of ½ period (10 ms in 50 periods) after separation of the contacts; by reason of asymmetrical defects, this time-lag is of the order of 20 ms in actual practice. It is therefore during such a time interval (which is further increased by the time required for cooling of the contacts) that quenching must be maintained in order to obtain final extinction of the arc. As a result, the volume of dielectric to be circulated for the quenching operation must be of much greater volume (for example of the order of ten times greater) than in the above-mentioned case of direct-current circuit-breakers.

In the third patent cited in the foregoing, the intense circulation of the quenching dielectric was produced by a piston connected to the moving contact. At a moment of opening of the contacts, this piston produced as a result of its displacement an increase in the general volume filled with liquefied $SF_6$. As a consequence, the displacement of said piston in fact produced the desired circulation of fluid for the quenching process but also caused a reduction of the general pressure of the dielectric; this reduction was of relatively small magnitude (for example of the order of 5 to 10 $kg/cm^2$) since the volume of liquid thus circulated was in turn of a low order.

If it was desired to employ a quenching system of this type for the purpose of circulating the larger volumes of liquid which are necessary for quenching in an alternating-current circuit-breaker, the reduction of pressure within the general volume of the dielectric would be such that, at the end of the quenching process, the final pressure of the dielectric would no longer be sufficient to maintain this latter in the liquid state.

In order to overcome this disadvantage, it would be possible either to increase the general pressure of the dielectric or to increase the volume of dielectric in order to ensure that the final pressure remains sufficient at the end of the quenching process. It has been observed, however, that it would be necessary to increase the pressure and/or the volume of the dielectric to values which are unacceptable in practice.

The present invention makes it possible to overcome this drawback without any appreciable increase in volume and with acceptable pressures and permits the construction of a liquefied $SF_6$ circuit-breaker in which quenching of the arc with liquid dielectric can be carried out at a high rate of flow over a considerable period of time which is compatible with the interruption of alternating currents whilst the general pressure of the dielectric remains substantially constant in spite of arc-quenching during the opening operations of the circuit-breaker.

In accordance with a characteristic feature of the invention, the circuit-breaker comprises a main chamber or interrupting chamber which contains the stationary and moving contacts, and an auxiliary chamber or quenching cylinder which is divided into two compartments having volumes which are inversely variable by means of a piston actuated conjointly with the moving contact, the first compartment being intended to communicate with the interrupting chamber through a duct in the form of a nozzle which has its opening in the vicinity of and between the contacts whilst the second compartment is in direct free communication with the interrupting chamber.

As a preferable feature, the volume of the first compartment is of minimum value to the closed position of the contacts so that the circulation of the quenching dielectric takes place in the centripetal direction in the region of the contacts or in other words by "suction" of the dielectric which is present between the contacts.

In one embodiment, the piston is continuously coupled to the moving contact. In another embodiment, the piston is coupled to the moving contact only during part of its travel whilst the remaining portion of its travel (which has the effect of quenching the arc) takes place after the moving contact has reached its position of maximum separation during an opening operation of the circuit-breaker.

In a circuit-breaker in accordance with the invention, the aforementioned duct in the form of a nozzle can be constituted at least in part by one of the contacts in cooperating relation with the other contact or alternatively by one of the contacts in cooperating relation with elements for guiding the arc-quenching stream which are independent of the contacts, or alternatively either partly or wholly by the contacts and/or by guiding elements which are independent of said contacts.

As disclosed in the patents cited earlier, it is readily apparent that the circuit-breaker chamber which is filled with liquid $SF_6$ is maintained at a substantially constant pressure in time by means which serve to compensate for the thermal expansion of the $SF_6$, the variations thus compensated being in this case only slow variations and not the practically instantaneous variations which could occur during opening or closing operations of the circuit-breaker.

In the following description, the terms "hypercritical state" or "hypercritical pressure" will be employed to define the state of the dielectric consisting of $SF_6$ gas maintained in the liquid state by the pressure which is cntinuously applied thereto (for example by means of a hydropneumatic accumulator) and which fills the interrupting chamber as well as the quenching cylinder of the circuit-breaker.

These terms are understood to mean that the dielectric is normally at a pressure which is considerably higher than the critical pressure $Pc$, this value being defined as the pressure at which a gas can be just liquefied when it is at its critical temperature, that is to say beyond which the gas is no longer liquefiable as a result of an increase in pressure.

In the case of $SF_6$, the critical pressure $Pc$ is 36.8 atmospheres. It has been seen that, in a circuit-breaker in accordance with the invention, the liquid dielectric stream or jet used for arc-quenching is produced by a difference in pressure (at the moment of separation of the contacts and even after complete separation of the contacts if necessary) between the first compartment of the quenching cylinder and the interrupting chamber.

In the preferred embodiment of the invention in which the volume of the first compartment is of minimum value in the closed position of the contacts, the arc-quenching jet is therefore produced by creating a relative vacuum within the first compartment. If it has been determined with a view to obtaining a given rate of flow of quenching liquid that said relative vacuum or negative pressure (that is, the pressure difference between the interrupting chamber and the first compartment) should be $\Delta P$ (for example 50 kg/cm²), the normal pressure $P_N$ of the dielectric in the state of rest will be at least equal to: $P_N = Pc + \Delta P$ (for example $P_N = 37 + 50 = 87$ kg/cm²) in order to ensure that the pressure within the first compartment does not fall below the critical pressure during the arc-quenching period.

A pressure of this order can therefore be correctly defined as hypercritical since it is very substantially higher than the critical pressure, for example of the order of 2 to 4 times higher than this latter. This hypercritical pressure provides a means of ensuring that no gas phase is liable to appear within the liquid dielectric as a consequence of arc suppression, at least up to the critical temperature. As stated in the patents cited earlier, this could be a major drawback since the properties of extinction of the dielectric gas $SF_6$ in the liquid state are much better than in the gaseous state.

It is apparent from the foregoing that the problems raised by arc suppression or quenching in a circuit-breaker which contains a dielectric of the liquefied gas type are entirely different from those encountered in circuit-breakers of known tyes in which the dielectric is in the liquid state at normal pressures (oil, for example) or in which the dielectric is a gas in the gaseous state ($SF_6$, for example). In fact, in these known circuit-breakers, the problem of change of state of the dielectric does not have to be taken into consideration.

It should further be noted that, in the case of the circuit-breakers described in the first two patents cited earlier, the pressure variations which were liable to effect the dielectric were only due to variations in temperature (but not due to the creation of a partial vacuum in a particular zone of the chamber filled with dielectric). In both patents aforementioned, it was proposed to maintain the liquefied dielectric gas under a pressure in the vicinity of or higher than the critical pressure. In fact, the pressure specified in the case of $SF_6$ was 35 kg/cm² and there was therefore no question in this case of a pressure of considerably higher value than the critical pressure. On the contrary, in the third patent mentioned earlier, it was proposed to utilize only the inherent volumetric elasticity of the liquid dielectric in the compressed state within the circuit-breaker as resilient means for tripping this latter. In order to store resilient energy with a view to imparting substantial acceleration to the moving contact by virtue of the compressibility of the liquid dielectric, it was found necessary in this case to maintain the dielectric under a very high pressure, for example a pressure within the range of about 200 to 400 kg/cm² in the case of $SF_6$ or in other words approximately 6 to 12 times higher than the critical pressure of this gas. In the present invention, however, the so-called "hypercritical" pressure at which the dielectric fluid is maintained is only of the order of 2 to 4 times the critical pressure.

The circuit-breaker in accordance with the invention offers a technical improvement over known types of circuit-breakers for alternating currents, especially by virtue of the fact that the distances of separation of the contacts can be very small. This permits very short time-delays during an opening operation while also permitting arc-quenching over an extended period which, after extinction of the arc, ensures cooling of the contacts and complete de-ionization of the dielectric fluid.

Moreover, by virtue of the fact that the dielectric consisting of the liquefied gas $SF_6$ has excellent insulating properties, the elements for guiding the arc-quenching stream can be placed in relatively close proximity to each other although they are at different potentials. Said elements can thus constitute a nozzle having a relatively small cross-sectional area which provides a high arc-quenching flow rate and produces high turbulent velocity fluctuations which are conductive to cooling and extinction of the arc.

A clearer understanding of the invention will be gained from a perusal of the following detailed description and from a study of the accompanying drawings in which a number of embodiments of the invention are given by way of example without any limitation being implied, and in which:

FIG. 1 is a sectional view of a circuit-breaker in accordance with one of the embodiments of the invention;

FIGS. 2*a* and 2*b* are partial views of the same circuit-breaker shown in two different positions during an opening operation;

FIGS. 4 and 5 are general views of a circuit-breaker in accordance with either FIG. 1 or FIG. 3 and showing respectively an assembly in insulating gas and an assembly in air;

FIG. 6 is a part-sectional view of a circuit-breaker in accordance with the invention in which one of the elements for guiding the arc-quenching stream is constituted by the moving contact;

Figure 1:
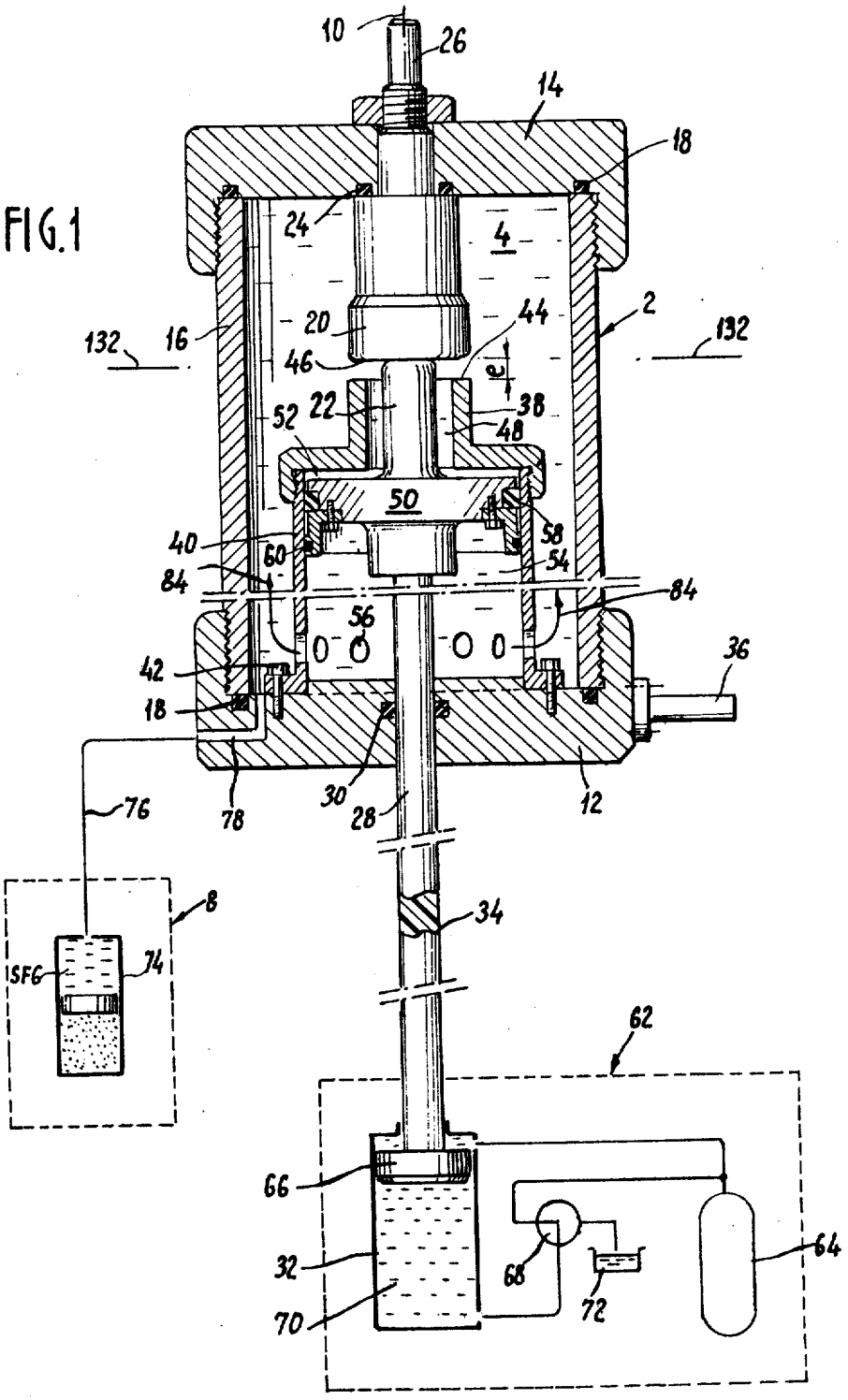

The circuit-breaker which is illustrated in FIG. 1 comprises a fluid-tight interrupting chamber 2 having an internal space 4 filled with $SF_6$ which is maintained in the liquefied state under a substantially constant pressure by means 8 which will be described hereinafter and serve to compensate for the thermal expansion of the $SF_6$.

The pressure of the $SF_6$ within the interrupting chamber is maintained at an appreciably higher value than the critical pressure of the $SF_6$ and is 2 to 5 times higher, for example.

The current-interrupting chamber 2 has substantially a shape of revolution about the axis 10 and is provided with two end-walls 12 and 14 through which the axis 10 passes and which are electrically insulated from each other.

In the form of construction which is shown in FIG. 1, the two end-walls 12 and 14 are of metal whilst the cylindrical wall 16 of the interrupting chamber is formed by means of an insulating tube, for example of plastic material reinforced with glass fiber or a similar reinforcement material in order to afford resistance to the pressure which prevails within the interior of the chamber.

Seals 18 ensure fluid-tightness of the chamber at the point of junction between the end-walls and the cylindrical wall 16.

The stationary contact 20 and the moving contact 22 of the circuit-breaker are placed within the interior of the chamber and along the axis 10. The stationary contact 20 is mounted on the end-wall 14 with interposition of a seal 24 and the top portion 26 of said contact which emerges from the interrupting chamber constitutes one of the connecting terminals of the circuit-breaker.

The moving contact 22 is supported by a metallic rod 28 which is capable of sliding through the end-wall 12 with interposition of a fluid-tight packing 30.

In the closed position of the circuit-breaker which is shown in FIG. 1, the two contacts 20–22 are applied against each other solely under pressure without interfitting engagement of the contacts. To this end, a hydraulic jack 32 produces action of the rod 28 by means of an insulating rod 34 so as to maintain the contacts applied against each other under high pressure as described in French Pat. No. 1,211,608 filed on Aug. 27, 1958 in the name of the present inventor.

In the embodiment shown in FIG. 1, the same jack also produces the separation of the contacts for the opening of the circuit-breaker.

It is apparent that, since the moving contact 22 is rigidly fixed to the rod 28 which passes through the metallic end-wall 12, said end-wall and the moving contact are at the same potential, with the result that the other terminal 36 of the circuit-breaker is mounted on said end-wall. It will be seen hereinafter that additional sliding contacts permit the flow of current between the moving contact and the terminal 36.

The system adopted for quenching the arc by means of a liquid dielectric jet in a circuit-breaker in accordance with the invention will now be described.

In the embodiment which is illustrated in FIG. 1, this quenching system comprises a first element 38 for quiding the arc-quenching jet, said element being mounted within the interior of the current-interrupting chamber.

As shown in FIG. 1, said first guiding element is constituted by a sleeve component secured by screwing, for example, to the extremity of a metallic cylinder 40 (which will be described in greater detail hereinafter), said cylinder being in turn secured to the end-wall 12 by means of screws 42. The sleeve component 38 is preferably of metal but could also be formed of insulating material such as, for example, a fluorinated polymer such as polytetrafluoroethylene or polytrifluoromonochloroethylene.

The upper edge 44 of the sleeve component 38 is placed opposite to a second element for guiding the arc-quenching jet, said second guiding element being constituted in the case shown in FIG. 1 by the bottom surface 46 of the stationary contact 20.

The sleeve component 38 surrounds the moving contact 22 so as to form between the two members an axially directed annular duct 48 which constitutes in conjunction with the opposite surfaces 44–46 a radial nozzle for centripetal quenching in which the liquid dielectric circulates during separation of the contacts.

Circulation of the quenching dielectric is produced by a piston 50 which is rigidly fixed both to the moving contact 22 and to the rod 28. The piston 50 is slidably mounted within the cylinder 40 and divides said cylinder into a first compartment 52 which communicates with the annular duct 48 and a second compartment 54 which communicates directly with the internal space 4 of the interrupting chamber by means of a plurality of large-diameter orifices 56 having a total cross-sectional area for flow which is several times larger than the flow cross-section of the duct 46. In the preferred embodiment of the invention, the volume of the compartment which communicates with the duct 48, that is to say the space or compartment 52, is of minimum value in the closed position of the circuit-breaker (as shown in FIG. 1).

The piston 50 is fitted with a packing-ring 58 which may be designed to ensure only relative fluid-tightness between the two faces of the piston 50 without any essential need to withstand the so-called "hypercritical" pressure of the liquefied $SF_6$ which fills the entire chamber.

Sliding contacts 60 can be mounted on the piston 50 in frictional contact with the internal wall of the cylinder 40 so as to ensure the flow of current from the moving contact 20 to the terminal 36.

Before describing the operation of the arc-quenching system in a circuit-breaker in accordance with the invention, a brief indication will now be given in regard to the means employed for actuating the moving contact and the means which serve to provide compensation for the thermal expansion of the $SF_6$, one example of which is given by way of illustration in FIG. 1.

The actuating means 62 can be constituted by a conventional hydraulic circuit-breaker control system which is held in the closed position under the action of oil pressure and released by resilient means of mechanical or pneumatic type. Accordingly, the control system can comprise a double-acting differential jack 32 supplied from an oleopneumatic accumulator 64, the top face of the piston 66 of the jack 32 being continuously subjected to the pressure of the accumulator 64.

In the closed position of the circuit-breaker (as shown in FIG. 1), the valve 68 puts both faces of the piston 66 into communication with the high pressure and it is therefore the differential force applied to these two faces which has the effect of maintaining the moving contact 22 applied under pressure against the stationary contact 20. In order to initiate tripping action, it is only necessary to operate the valve 68 in order to connect the lower compartment 70 of the jack 32 to the collector-tank 72. It is clearly possible to employ any other type of trip system such as a spring, for example.

The system 8 which provides compensation for the thermal expansion of the liquid $SF_6$ within the interrupting chamber essentially comprises a hydropneumatic accumulator 74, the lower compartment of which is filled with gas under pressure (air, nitrogen or helium, for example) whilst the upper compartment is filled with liquid $SF_6$ and communicates with the interrupting chamber through a small-section pipe 76 connected to a duct 78 which is pierced in the end-wall 12 of the interrupting chamber. Compensation systems of this type have been described in the above-cited patents together with their ancillary components for control and safety which do not form part of the present invention.

Figure 2B:
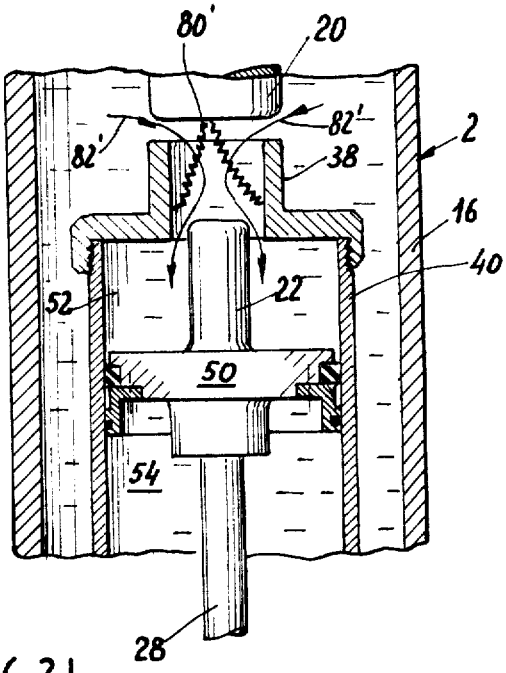
Figure 2A:
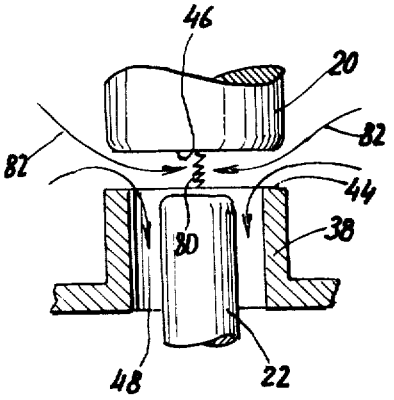

Assuming now that the circuit-breaker is initially in the closed position as shown in FIG. 1 and that a trip order is given to the control system 62, the piston 66 of the jack 32 is displaced downwards and the moving contact 22 begins to move away from the stationary contact 20 (as shown in FIG. 2*a*) at a high rate of acceleration whilst the arc 80 is struck between the contacts. At the same time, the arc-quenching piston 50 moves downwards within the cylinder 40 and produces a high degree of relative partial vacuum within the compartment 52, thus initiating a flow of liquefied dielectric in the direction of the arrows 82.

This liquid jet is guided between the opposite surfaces 44 and 46 which form a narrow nozzle in which the liquid is accelerated to high velocity (as will be seen hereinafter, it is due to the liquefied dielectric $SF_6$ that this nozzle can be of small diameter and therefore highly efficient).

Between the contacts, the arc-quenching jet is therefore radial and centripetal, thus centering the arc and producing at the center of the jet a very high degree of tubulence which is conducive to rapid de-ionization of the arc. The jet then follows the annular duct 48 so as to compensate for the relative vacuum produced within the compartment 52 by the displacement of the piston 50.

If the circuit-breaker in accordance with the invention were employed for interrupting a direct current, the interruption would be terminated and the arc extinguished when the moving contact 22 reached substantially the position shown in FIG. 2*a*, that is to say when the top face of the moving contact 22 is substantially at the same level as the top face 44 of the sleeve component 38.

In fact, in the preferred case in which the stationary sleeve 38 is a metallic component, this latter is at the potential of the terminal 36 whereas the stationary contact 20 located opposite to the sleeve is at the potential of the terminal 26. The spacing *e* (as shown in FIG. 1) is therefore chosen so as to ensure that, in the open position of the circuit-breaker, said spacing is greater than the insulating distance corresponding to the voltage employed. It has been seen that, in the liquefied dielectric $SF_6$, said spacing is approximately 5 mm in the case of a voltage of 100 kilovolts. This makes it possible to endow the quenching nozzle with a relatively small cross-sectional area so as to produce a high arc quenching flow velocity in respect of a predetermined relative vacuum within the compartment 52. If another dielectric were employed such as oil or an insulating gas, for example, said distance *e* would be much greater and the displaced volume of dielectric would be considerably larger in order to obtain the same quenching effect.

The circuit-breaker in accordance with the present invention is designed for the interruption of alternating currents and it is with this objective that quenching of the arc is continued even after the contacts have withdrawn to a distance which is sufficient to ensure maintenance of insulation.

In fact, in the case of interruption of an alternating current, if separation of the contacts has commenced shortly before a zero-crossing of the current so that the separation of the contacts is insufficient to extinguish the arc at the time of this initial zero-crossing, it would be possible to interrupt the current only at the time of the following zero-crossing which takes place one half-period after said initial zero-crossing, namely 10 milliseconds (ms) later in the case of current at 50 cycles and in the case of a symmetrical current. If the current to be interrupted is asymmetrical, this time-lag is liable to attain 18 ms. Moreover, the arc-quenching action must be maintained during a predetermined time interval after interruption in order to ensure cooling of the contacts and complete de-ionization of the dielectric fluid, said time-lag being correspondingly longer as the arc has been maintained for a longer period. In practice, the arc-quenching time must be approximately 30 ms.

In accordance with the invention, the quenching action is therefore extended in time as a result of continued displacement of the quenching piston 50. This displacement continues to produce an increase in volume of the compartment 52 (as shown in FIG. 2*b*) and consequently to maintain the stream of dielectric liquid within the axial duct of the sleeve component 38 in the direction of the arrows 82' (as shown in FIG. 2*b*). At the same time, the reduction in volume of the compartment 54 of the quenching cylinder 50 causes the discharge of the liquid $SF_6$ contained in said compartment towards the interrupting chamber through the orifices 56 (as shown by the arrows 84 in FIGS. 1 and 2*b*).

It is apparent from the direction of the arrows 82' as shown in FIG. 2b that the arc 80' is continuously centered by the quenching jet and that this latter produces a high degree of turbulence in the central region beneath the stationary contact 20 by reason of the centripetal radial direction of the quenching jet.

In the case shown in FIGS. 1 and 2 in which the guiding sleeve component 38 is of metal, the extremity of the arc comes into contact with the bottom face of the sleeve component and increases in length until it is interrupted at the following instant of zero-crossing of the current. By way of example, this interruption takes place in the most unfavorable case approximately 18 ms after initial separation of the contacts. The piston 50 continues to move downwards after extinction of the arc so as to maintain the circulation of liquid for the purpose of cooling the contacts and deionization.

In order to reclose the circuit-breaker, it is only necessary to return the valve 68 to the position shown in FIG. 1. The piston 66 of the jack 32 moves upwards and is accompanied by the arc-quenching piston 50 and the contact 22 in the upward direction. There then takes place a centrifugal radial circulation of liquid within the nozzle but this quenching action serves no useful purpose at the moment of closure of the contacts.

In the embodiment shown in FIGS. 1 and 2, the jet of quenching fluid is formed at the moment of separation of the contacts by creating a relative vacuum within the compartment 54 of the quenching cylinder 40. Postulating that the pressure at which the $SF_6$ gas is maintained in the liquefied state within the interrupting chamber has the value P and postulating that the relative vacuum which it is necessary to create in order to obtain a satisfactory quenching flow rate has the value $\Delta P$, the pressure which will prevail within the compartment 54 during an opening operation will be $P-\Delta P$. However, it is quite clear that in order to maintain the dielectric $SF_6$ in the liquid state at each moment, its pressure must not fall below the critical pressure (namely 37 kg/cm$^2$) or in other words that $P-\Delta P$ must never be lower than the critical pressure. From this it follows that, if the relative pressure $\Delta P$ has a selected value of 50 kg/cm$^2$, the pressure P at which the $SF_6$ is maintained compressed within the interrupting chamber must be at least 87 kg/cm$^2$, that is to say a pressure which is appreciably higher than the critical pressure and has been designated by the term "hypercritical pressure".

In a circuit-breaker in accordance with the invention, there exists in the case shown in FIG. 1 another cause of variation in pressure of the liquid dielectric. In point of fact, a certain length of the control rod 28 emerges from the interrupting chamber during an opening operation, with the result that the pressure of $SF_6$ is lower in the open position of the circuit-breaker than in the closed position. However, the cross-section of the rod 28 is of very small value with respect to the area of the end-wall 12 of the interrupting chamber (for example 1/100) and the range of travel of the rod is shorter than the total length of the interrupting chamber, with the result that the variations in volume are smaller than 1/100 and the corresponding pressure variations are of relatively small value.

If so desired, this variation in volume could be completely suppressed, for example by means of a control system which produces action in rotational motion.

It can therefore be stated that the dielectric is continuously maintained in the liquid state under a substantially constant pressure, the more so as there occurs a certain compensation for the pressure drop (throughout the interrupting chamber and within the compartment 54) as a result of heating of the dielectric caused by the passage of the arc at the moment of opening of the contacts and by the pressure drop within the upper compartment 52 of the quenching cylinder, which produces a compensating pressure rise within the internal spaces 4 and 54.

The dimensions which it is preferable to give to the quenching piston 50 will be discussed later in connection with FIG. 6. It is sufficient to state for the moment that good results are obtained with an apparatus in accordance with FIG. 1 when the piston 50 has an area which is approximately ten times larger than the cross-sectional area of the annular duct 48.

Figure 3:
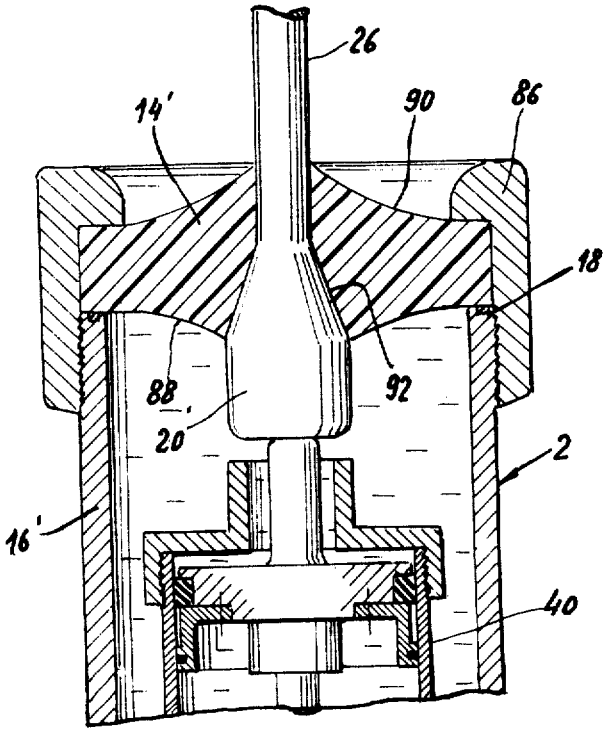
FIG. 3 is a part-sectional view of an alternative form of construction of FIG. 1.

In the alternative embodiment shown in the part-sectional view of FIG. 3, the structure of the interrupting chamber is different from that shown in FIG. 1 in regard to the electrical insulation of the two end-walls of the chamber. In this alternative form of construction, the cylindrical wall 16' of the interrupting chamber is of metal and preferably made of non-magnetic metal such as stainless steel in order to prevent eddy currents. As in the embodiment of FIG. 1, the bottom end-wall (not shown in FIG. 3) is also constructed of metal. The top end-wall 14' is formed of insulating material such as a molded epoxy resin, for example; this end-wall is secured to the cylindrical wall 16' by means of a screwed metal ring 66 with interposition of a seal 18'.

The faces 88–90 of the end-wall 14' are preferably given a curved profile in order to increase the length of the leakage paths and also in order to endow the internal face 88 with resistance to the internal hypercritical pressure of the liquid $SF_6$. The stationary contact 20' on which the end-wall 14' can be molded directly has preferably a conical portion 92 which ensures a good standard of fluid-tightness by wedging between the contact and the end-wall 14'. As will be readily understood, it would also be possible to provide a shouldered portion on the contact and a seal as in the case of FIG. 1.

The alternative embodiment of FIG. 3 also ensures electrical insulation of the two end-walls of the interrupting chamber and permits a more simple construction than in the case of FIG. 1, especially by virtue of the use of a metal tube for the cylindrical wall of the interrupting chamber.

Figure 4:
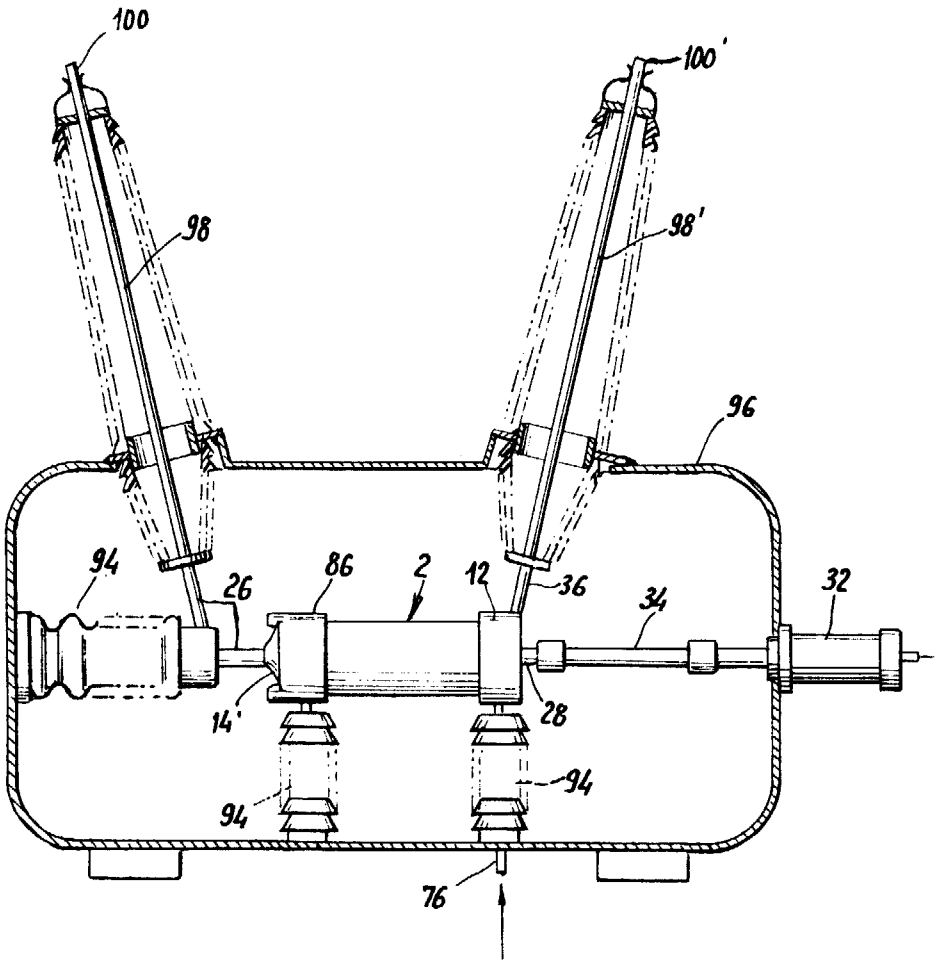

In a circuit-breaker according to the invention, the interrupting chamber can be mounted in an insulating gas atmosphere (as shown in FIG. 4) or alternatively on an insulating column in air (as shown in FIG. 5).

In the first case, the interrupting chamber 2 (such as a chamber of the type described with reference to FIGS. 1 and 3) is fixed on insulating supports 94 within a substantially cylindrical tank 96 filled with insulating gas such as $SF_6$ in the gaseous state under low pressure.

The two terminals 26 and 36 of the interrupting chamber are connected to conventional insulated lead-in components 98—98', the circuit-breaker terminals 100—100' being accessible at the ends of said components.

There can again be seen in FIG. 4 the different elements which were described with reference to FIGS. 1 and 3, especially the operating rod 28 of the moving contact and of the quenching piston, the insulating link-rod 34 and the jack 32 of the hydraulic circuit-breaker control system.

The pipe 76 which serves to compensate for the thermal expansion of the liquid $SF_6$ as well as to fill the interrupting chamber with liquid $SF_6$ and to maintain a substantially constant pressure can be connected to the duct 78 (shown in FIG. 1) formed in the end-wall 12 of the interrupting chamber by being passed through one of the insulating supports 94 in order to be accessible from the exterior of the tank 96.

In the form of construction of an air-type circuit-breaker shown in FIG. 5, the interrupting chamber 2 (of the type shown in FIG. 3) is mounted on an insulating support column 102 which can be filled with $SF_6$ in the gaseous state under low pressure.

The control rod 28 and the insulating link-rod 34 pass within the interior of the insulating column 102 and the same applies to the pipe 76 which serves to supply liquefied $SF_6$ to the interrupting chamber.

The hydraulic control jack 32 is mounted beneath the insulating column 102 which is supported on a frame 104.

The upper portion of the circuit-breaker is insulated by a second insulating column 106 which can also be filled with gaseous $SF_6$ under low pressure and which is traversed by the output connection 26 of the interrupting chamber. Access can be gained to the terminal 100 of the circuit-breaker at the top of the insulating column 106.

Another form of construction of an interrupting chamber for a circuit-breaker in accordance with the invention is shown in the part-sectional view of FIG. 6. The constituent elements of the chamber itself (end-wallls 12–14, cylindrical wall 16) can be indifferently of the types shown in FIG. 1 or 3 and are not illustrated in their entirety.

In this embodiment, one of the elements for guiding the arc-quenching jet is again the stationary contact 20 (as in the case of FIGS. 1 and 3) but the second guiding element is no longer constituted by a stationary element such as the sleeve 38 but by the moving contact 108 itself in which is pierced an axial passageway 110 which opens into the upper compartment 72 of the quenching cylinder 40.

The arc-quenching cylinder 40 is similar to the cylinder described earlier but the piston 50 is not permanently fixed to the moving contact 108 as in the previous embodiments. In other words, during a part of the travel such as the opening travel, for example, the piston 50 and the moving contact move together; then, when the moving contact has reached the distance *e* of separation which is necessary for insulation in the open position, the moving contact stops by application of a shouldered portion 112 against the top face of the quenching cylinder 40. The piston 50 which continues to be displaced by the control rod 28 is separated from the moving contact and produces an increase in the volume of the compartment 52 of the quenching cylinder. Thus, by creating a relative vacuum within said compartment, the radial centripetal quenching action is extended in the direction of the arrows 82 over a considerable period of time after the moving contact has reached its position of maximum separation.

A spring 114 preferably tends to maintain the moving contact applied against the top face of the piston 50 during that portion of the travel (opening travel as well as closing travel) in which these two components move together.

Ports 115 for the circulation of the liquid dielectric are formed in the upper portion of the quenching cylinder 40 and provision is made on the bottom annular flange of the moving contact for a packing-ring 117 which ensures relative fluid-tightness.

In the closed position of the circuit-breaker, the piston 50 which is displaced by the control rod 28 bears against the bottom face of the hollow moving contact 108 and the top face of this latter is applied under pressure against the stationary contact 20. Sliding contacts which are not shown in FIG. 6 ensure the passage of the current from the moving contact to the quenching cylinder 40 which is at the potential of the output terminal 36.

Figure 7:
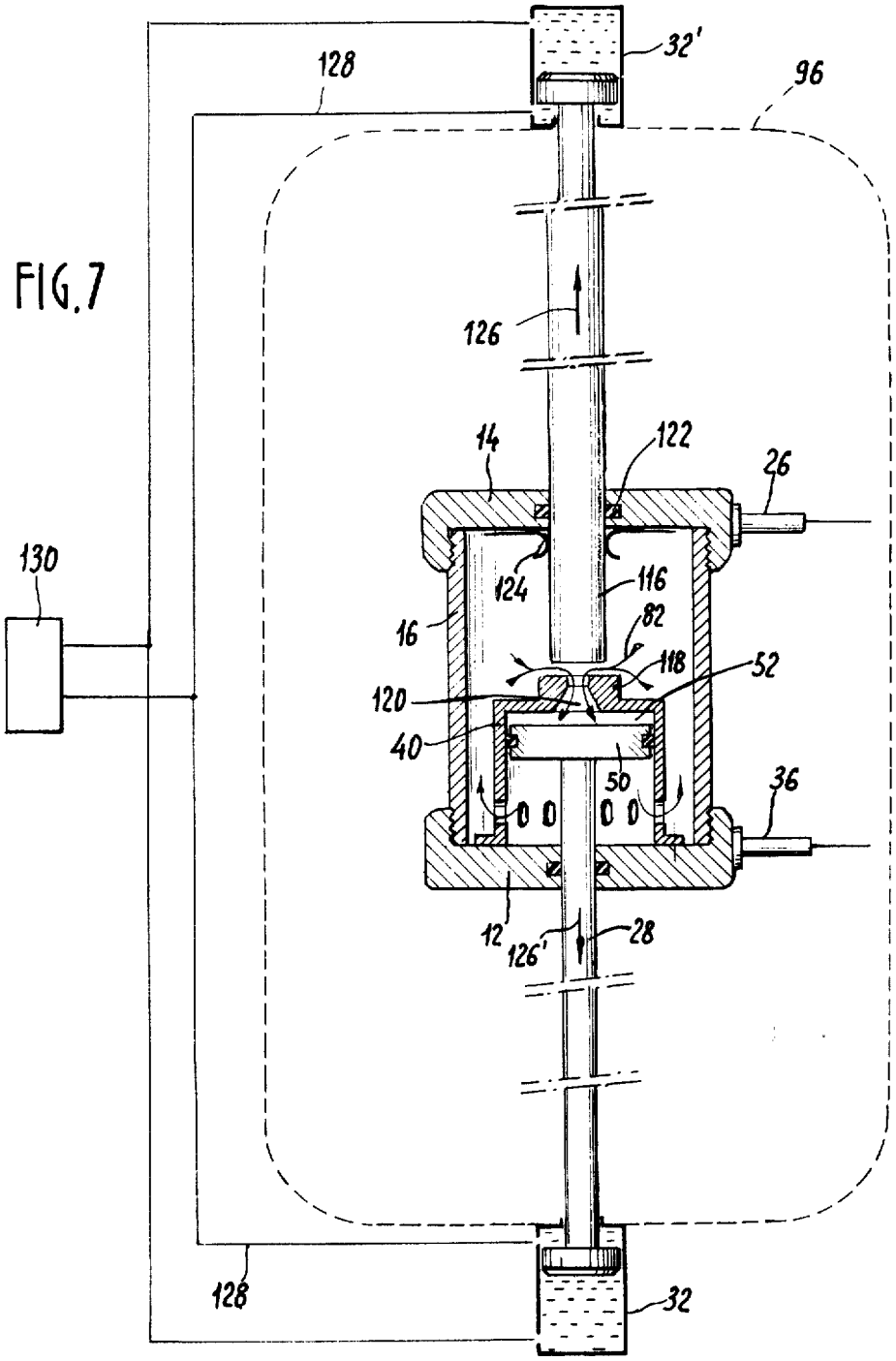
FIG. 7 is a part-sectional view of another alternative embodiment in which the axial quenching duct is formed in the stationary contact.

In the embodiment illustrated in FIG. 7, the first quenching stream guiding element is constituted by the moving contact 116 whilst the second guiding element is constituted by the stationary contact 118 but an axial quenching passageway 120 is pierced in the stationary contact and not in the moving contact as in the case of FIG. 6.

The axial passageway 120 opens into the compartment 52 of the quenching cylinder 40 which is rigidly fixed to the bottom end-wall 12 of the interrupting chamber and the top end of which carriers the stationary contact 118. In this embodiment, the moving contact 116 passes through the top end-wall 14 of the interrupting chamber with interposition of a packing-ring 122 whilst sliding contacts 124 permit the passage of current to the output terminal 26.

At the time of opening of the circuit-breaker, the moving contact 116 and the quenching piston 50 are displaced in synchronism but in opposite directions as indicated by the arrows 126—126', thereby ensuring that centripetal radial quenching is established in the direction of the arrows 82 at the same time as the separation of the contacts.

The simultaneous or substantially simultaneous displacements of the piston and of the moving contact 116 in opposite directions can be produced respectively by a hydraulic jack 32 and by a hydraulic jack 32' placed outside a tank 96 filled with insulating gas in accordance with the arrangement shown in FIG. 4. A common hydraulic connection 128 between the jacks 32 and 32' and in the direction of a control cubicle 130 of conventional type makes it possible to obtain the coordinated displacements of the two moving elements both at the time of opening and at the time of closing of the circuit-breaker.

A time-delay device which can readily be provided in a hydraulic transmission system can make it possible to initiate operation of the quenching piston 50 at the time of opening of the circuit-breaker and shortly before commencement of the flow motion produced by the moving contact 116.

It will readily be understood that other coupling systems of the mechanical type, for example, could also be employed.

Motion-stopping means (not shown) serve to limit the travel of the moving contact 116 in order to ensure that the distance between the stationary and moving contacts does not exceed the insulating distance *e* aforementioned to any appreciable extend so as to retain the advantage of the narrow quenching nozzle throughout the duration of travel of the piston 50.

Figure 8:
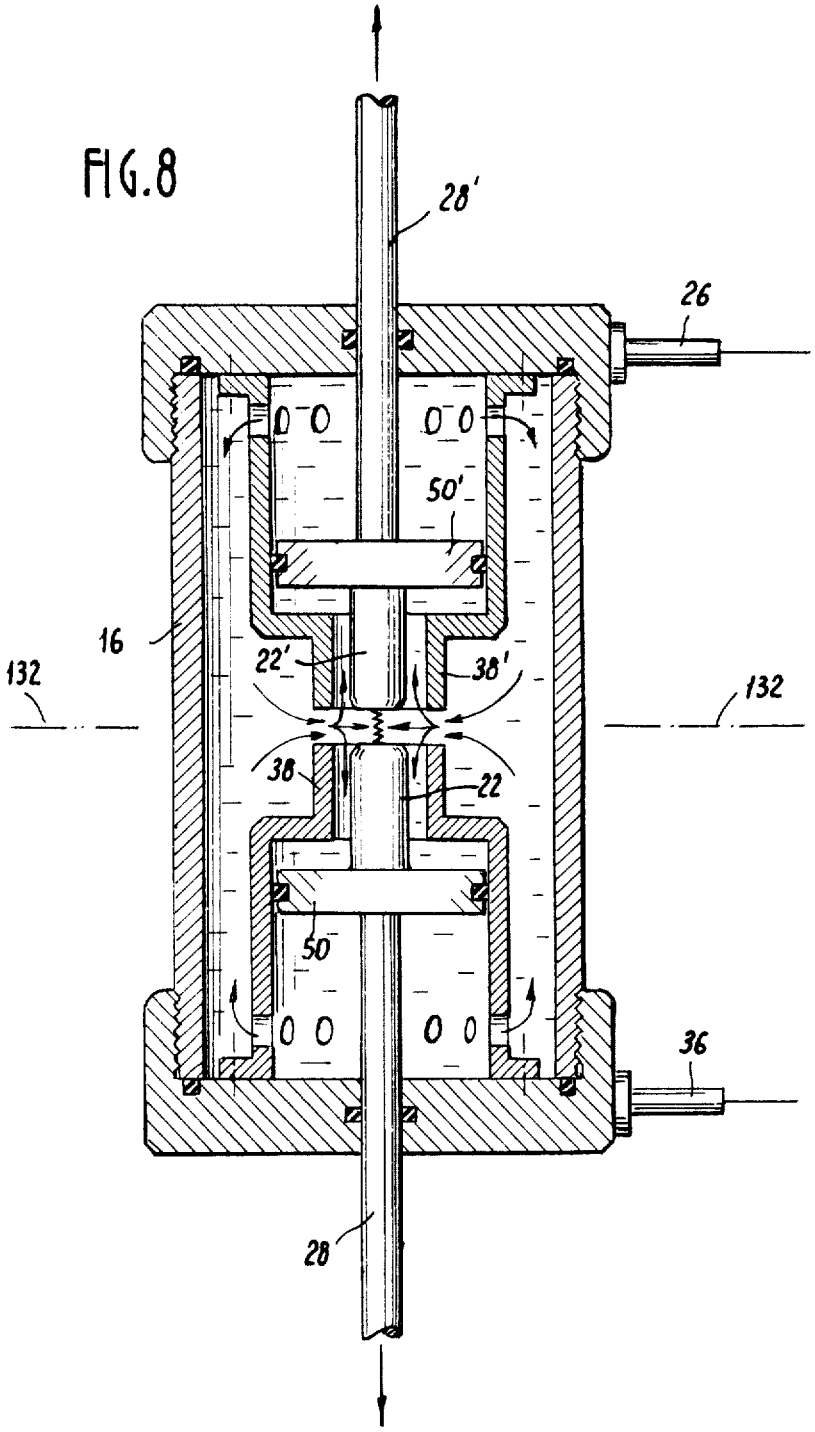
FIG. 8 is a part-sectional view of yet another alternative embodiment in which provision is made for centripetal radial quenching with double flow of the quenching fluid.

In the alternative embodiment of FIG. 8, a provision is made for a double quenching system in oppositely-facing relation. In other words, the components located beneath a plane 132—132 in the embodiment shown in FIG. 1 are all placed opposite to each other and symmetrically with respect to said plane. These components are designated by the same reference numerals as in FIG. 1 (followed by the prime index in the case of those which are located above the plane 132—132).

It is sufficient to state that, in FIG. 8, the contacts have been shown during the movement of separation and at the beginning of an opening operation of the circuit-breaker, the two moving contacts 22–22' being displaced in opposite directions (together with the pistons 50–50' which are rigidly fixed thereto) by the rods 28–28' which are each actuated by a jack as in the case of FIG. 7.

It is readily apparent that the invention is not limited to the embodiments described with reference to the accompanying drawings and that, depending on the applications which are contemplated, it would not constitute any departure from the scope or the spirit of the invention to devise a large number of alternative forms of construction which are within the capacity of anyone versed in the art.

I claim:

1. An electric circuit-breaker for alternating current and containing a liquid dielectric consisting of $SF_6$ gas liquefied under a pressure which is always higher than the critical pressure, wherein said circuit-breaker comprises a main chamber or interrupting chamber which contains the stationary and moving contacts as well as an auxiliary or arc-quenching cylinder divided into two compartments having volumes which are inversely variable by means of a piston actuated conjointly with the moving contact, the first compartment being adapted to communicate with the interrupting chamber through a duct in the form of a nozzle for centripetal radial quenching which has its opening in the vicinity of and between said contacts whilst the second compartment is in direct communication with the interrupting chamber.

2. An electric circuit-breaker according to claim 1, wherein the volume of the first compartment aforementioned is of minimum value in the closed position of the circuit-breaker and wherein the dielectric is maintained in the liquefied state under a hypercritical pressure of the order of 2 to 3 times the critical pressure.

3. An electric circuit-breaker for alternating currents in which the arc is quenched by a stream of liquid dielectric, of the type comprising:

a fluid-tight interrupting chamber filled with $SF_6$ which is maintained in the liquefied state under a substantially constant pressure by means providing compensation for thermal expansion of the $SF_6$, said chamber being so designed as to have substantially a shape of revolution about an axis and to have two end-wall sections traversed by said axis and electrically insulated from each other;

two contacts which are placed within said chamber along said axis and at least one of which is displaceable in sliding motion along said axis, said contacts being applied against each other under pressure in the closed position of the circuit-breaker;

two cooperating elements of revolution for guiding the arc-quenching stream which are placed in oppositely-facing relation within the interior of said chamber and centered on said axis, at least one element being pierced by an axial duct;

at least one arc-quenching cylinder disposed along said axis and divided into two compartments having volumes which can be varied in inverse ratio by means of a moving piston, the first compartment whose volume is of minimum value in the closed position of the circuit-breaker being adapted to communicate with said axial duct;

wherein said two cooperating elements form in conjunction with said duct at least in the open position of the circuit-breaker a radial nozzle for centripetal quenching; wherein the second compartment is in direct communication with the interrupting chamber; wherein the moving piston and the moving contact are driven conjointly in their two directions of displacement by actuating means; and wherein the substantially constant pressure at which the liquid dielectric is maintained is a hypercritical pressure.

4. A circuit-breaker according to claim 3, wherein the two elements aforementioned for guiding the quenching stream are constituted respectively by the stationary contact and the moving contact in oppositely facing relation and wherein the axial duct aforementioned is pierced in said moving contact.

5. A circuit-breaker according to claim 4, wherein the piston is rigidly fixed to the actuating means aforementioned; wherein the moving contact has a shorter range of travel than that of said piston; and wherein said moving contact is displaced with said piston only along said shorter range of travel.

6. A circuit-breaker according to claim 3, wherein the two stream-guiding elements aforementioned are constituted respectively by the stationary contact and by a stationary sleeve which surrounds the moving contact and is located opposite to the stationary contact, the axial duct aforementioned being constituted by the annular duct located between the moving contact and the sleeve, wherein said moving contact is rigidly fixed to said piston and wherein said sleeve is attached to that end-wall of the interrupting chamber which is located nearest said moving contact.

7. A circuit-breaker according to claim 3, wherein the two stream-guiding elements aforementioned are each constituted by two stationary sleeves in oppositely-facing relation, each sleeve aforesaid being adapted to surround one of the contacts so as to form an annular axial duct between said contact and said sleeve, wherein the two contacts are intended to move in opposition and wherein said sleeves are attached respectively to each end-wall of the interrupting chamber.

8. A circuit-breaker according to claim 7, wherein the quenching cylinder is placed within the interior of the interrupting chamber.

9. A circuit-breaker according to claim 8, wherein the piston of the quenching cylinder is actuated by a sliding rod of small cross-section adapted to traverse the end-wall of the interrupting chamber on the side located nearest the moving contact through a packing-ring, said rod being connected to the actuating means aforementioned.

10. A circuit-breaker according to claim 7, wherein the sleeve or sleeves aforementioned are formed of electrically insulating material and especially of a fluorinated polymer such as polytetrafluoroethylene or polytrifluoromonochloroethylene.

11. A circuit-breaker according to claim 7, wherein the sleeve or sleeves aforementioned are of electrically conducting material and are at the potential of the corresponding end-wall of the interrupting chamber.

12. A circuit-breaker according to claim 11, wherein the aforementioned interrupting chamber having two end-walls electrically insulated from each other is constituted by a cylindrical wall of insulating material, said two end-walls being formed of metal and attached to the ends of said cylindrical wall.

13. A circuit-breaker according to claim 11, wherein the aforementioned interrupting chamber having two end-walls electrically insulated from each other is constituted by a first metal end-wall which is attached in fluid-tight manner to one of the ends of a metallic cylindrical wall and by a second end-wall of insulating material which is attached in fluid-tight manner to the other end of said cylindrical wall.

14. A circuit-breaker according to claim 3, wherein the two elements for guiding the arc-quenching stream are constituted respectively by the stationary contact and the moving contact, the axial duct aforementioned being formed in the stationary contact and wherein said stationary contact is carried by the quenching cylinder, combined means being provided for actuating the moving contact and the quenching piston in opposite directions and substantially at the same time.

15. A circuit-breaker according to claim 14, wherein the interrupting chamber aforementioned is placed within a tank filled with insulating gas under low pressure.

* * * * *